United States Patent [19]

Van Buren

[11] Patent Number: 4,833,835

[45] Date of Patent: May 30, 1989

[54] PORTABLE LIQUID AND GAS VALVE SEAT GRINDER

[76] Inventor: Donald F. Van Buren, 403 S. Harrison, O'Neil, Nebr. 68763

[21] Appl. No.: 192,970

[22] Filed: May 12, 1988

[51] Int. Cl.[4] ..... B24B 15/02

[52] U.S. Cl. ..... 51/241 VS

[58] Field of Search ..... 51/241 VS, 241 R; 408/83.5

[56] References Cited

U.S. PATENT DOCUMENTS

| | | | |
|---|---|---|---|
| 1,663,420 | 3/1928 | Stoll | 51/241 VS |
| 1,713,316 | 5/1929 | Yertson | 51/241 VS |
| 1,747,085 | 2/1930 | Roy . | |
| 2,292,383 | 8/1942 | Liebmann | 51/241 VS |
| 2,454,068 | 11/1948 | Kuhlman | 51/241 VS |
| 2,748,547 | 6/1956 | Davies et al. | 51/241 VS |
| 2,833,093 | 5/1958 | Shesler | 51/241 VS |
| 3,039,242 | 6/1962 | Ellenbogen . | |

FOREIGN PATENT DOCUMENTS

| | | | |
|---|---|---|---|
| 228887 | 10/1959 | Australia | 51/241 VS |
| 983135 | 2/1951 | France | 51/241 VS |
| 8720 | of 1907 | United Kingdom | 51/241 VS |

*Primary Examiner*—Roscoe V. Parker

*Attorney, Agent, or Firm*—James D. Welch

[57] ABSTRACT

A portable valve seat grinder and method of its use is disclosed. The portable valve seat grinder comprises a body element with a longitudinal hole there through, with bushings mounted in the longitudinal hole. The body element has screw threads on one end thereof which are of a proper pitch and diameter to mate with those on fluid flow control valves or an adaptor. The portable valve seat grinder also comprises a shaft, to one end of which is securely attached a grinding element. The shaft with attached grinding element is mounted in the body element by sliding the shaft into the bushings such that the grinding element is positioned near the screw threads on the body element. The outer surface of the body element can be knurled to aid with handling during use.

2 Claims, 1 Drawing Sheet

PORTABLE LIQUID AND GAS VALVE SEAT GRINDER

TECHNICAL FIELD

This invention relates to valve seat grinding apparatus and more particularly to apparatus for grinding valve seats in valves used to control the flow of liquid or gaseous fluid materials.

This invention was subject in Disclosure Document No. 187,250.

BACKGROUND

A search of prior patents reveals that many devices for use in the grinding of valve seats are known. A patent to Ellenbogen, U.S. Pat. No. 3,039,242 for instance, teaches a seat refacing tool for use with valves which control liquid and gas flow. The invention in said patent, however, does not provide means for precisely securing and aligning a grinding element to and with respectively a valve casing and valve seat so as to guarantee flush contact between the grinding element and the valve seat. Use of the Ellenbogen invention can lead to uneven grinding of a valve seat, as a result.

Further research of prior patents reveals a valve seat grinder in U.S. Pat. No. 1,747,085 to Roy. The invention in Roy provides an apparatus for use in grinding valve seats in automobile engines and the like. The invention provides a rotatable shaft within a hand-held body element. The hand-held body element embraces the rotatable shaft by way of bearings, and the rotatable shaft is securely mounted within the hand-held body element. The rotatable shaft, on one end thereof, has a grinding element and on the opposite end thereof a means for attachment to a rotation producing driver machine. As in the Ellenbogen invention the Roy invention, while providing means for applying a rotating grinding element at a valve seat location, fails to provide a means by which the grinding element can be secured to and aligned with a valve casing apparatus and valve seat, respectively, so as to guarantee flush contact between the grinding element and the valve seat.

A need exists for a simple and easy to use apparatus which can be secured to liquid and gas flow controling valve casings, which apparatus provides a rotating grinding element at the location of a valve seat in flush contact therewith.

DISCLOSURE OF THE INVENTION

The need identified in the Background section is met by the present invention. The present invention is comprised of a body and a shaft which mounts in the body by way of bushings, in a manner such that the shaft can rotate in the body, and move longitudinally within the body. The body of the present invention, at one end thereof provides screw threads which are of a pitch and diameter appropriate for mating with screw threads in a valve casing, or in an adaptor which can be attached to a valve casing. On the shaft, where it exists the body of the invention, on the end of the body where the screw threads are located, there is secured a grinding element. At the opposite end of the shaft there is means for attaching the shaft to a rotation producing driver machine.

In use the shaft with the grinding element attached will be slid into the body of the invention and be held in place by low friction contact with bushings in the body.

The grinding element will then be placed into a valve casing and the body of the invention screwed into firm contact with the valve casing, or an adaptor which is attached to a valve casing. The result will be to locate the grinding element so that direct flush contact with a valve seat can be achieved by moving the shaft longitudinally through the body of the invention toward the valve casing. By then causing the shaft to rotate the seat in the valve casing can be evenly ground to provide a smooth and even surface suitable for use in controlling fluid flow. The use of spacers which serve to limit the extent to which the body can be screwed into a valve casing, or adaptor which is attached to a valve casing is also disclosed. The spacers simply slide over the screw threads on the body and become positioned between the valve casing and body, when the present invention is attached to a valve casing or an adaptor.

SUMMARY OF THE INVENTION

A search of prior patents reveals that a need for an apparatus which can be attached to a liquid or gas flow control valve and allow even grinding of the seats in the valve, exists.

The present invention meets the need by providing an apparatus which is comprised of a body, and a shaft which longitudinally mounts in the body by way of low friction bushings. At one end of the body the are located screw threads suitable for allowing attachment of the invention to a valve casing or adaptor which attaches to a valve casing. A grinding element is secured to the shaft at the end of the shaft which exits the body at the end of the body at which the screw threads are located. In use the shaft with the grinding element attached thereto is slid into the body, and held in place by the bushings, with the grinding element being positioned near the body element screw threads. The body is then screwed onto a valve casing, or adaptor which attaches to a valve casing, and the grinding element caused to contact the valve seats in a flush manner. The grinding element is then caused to rotate by causing the shaft to rotate, which action causes the valve seat to be ground evenly into a smooth surface suitable for use in controlling fluid flow.

A purpose of the present invention is to provide a simple and economical apparatus which can be used to grind the seat in valves used to control the flow of liquids or gases.

DETAILED DESCRIPTION

Figure 1:
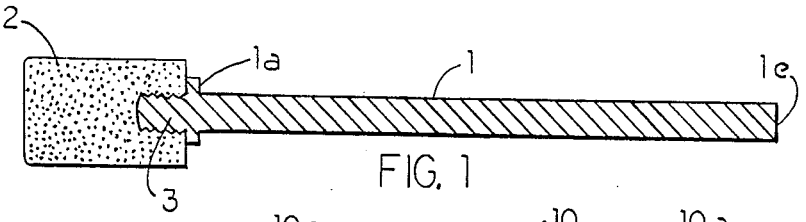
FIG. 1 shows a cross sectional view of the shaft and grinding element of the present invention.
Figure 2:
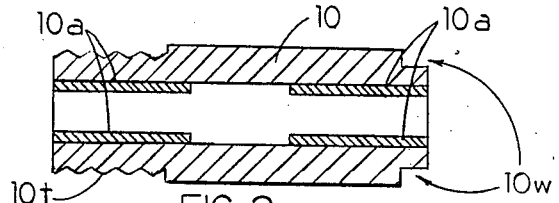
FIG. 2 shows a cross sectional view of the body element of the present invention.
Figure 3:
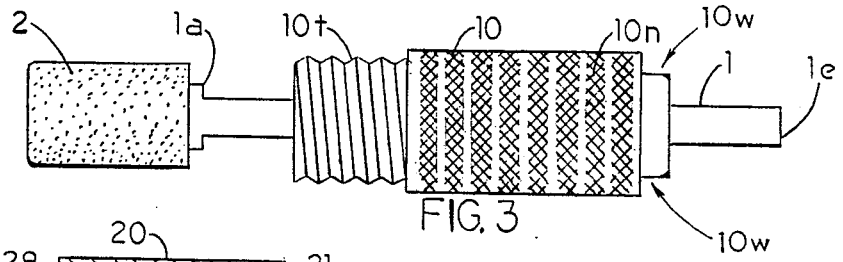
FIG. 3 shows a side elevational view of the present invention.

Turning now to the figures, in FIG. 1 there is shown, in cross section, a shaft (1) with end (1*e*), grinding element securing ring (1*a*) and grinding element (2). The shaft (1), attaches to the grinding element (2) via screw threads (3) or other attachment means. In FIG. 2 there is shown, in cross section, a body element (10), bearings or bushings, hereinafter referred to as bushings (10*a*) and body screw threads (10T). Body element screw threads (10T) can be female in an alternative embodiment. FIG. 3 shows the composite shaft (1) and grinding element (2) of FIG. 1 mounted in the body element (10) of FIG. 2. Note that shaft end (1*e*) slides through bushings (10*a*) into and through the body element (10) from the body element screw threads (10T) side of the body element (10). Note that body element (10) is, in the preferred embodiment, knurled (10N) on its surface, and provides for wrench access at (10*w*).

Figure 4:
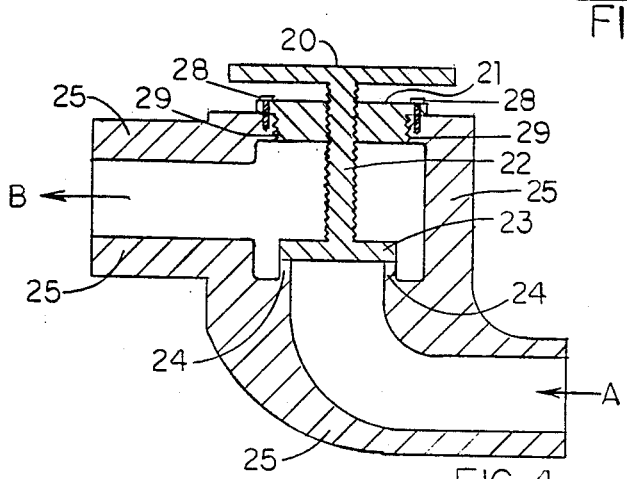
FIG. 4 shows a cross sectional view of a typical valve.

FIG. 4 shows a cross sectional view of a typical valve used to control the flow of liquids or gases. In particular, there is shown the valve casing (25), fluid entrance "A" and fluid exit "B" port locations, valve handle (20), valve handle platform (21), threaded valve handle shaft (22), valve casing screw threads (29), (note that securing bolts (28) can also be present), valve seat (24) and valve plug (23). Valve operation, involves turning valve handle (20) to position the valve plug (23) flush against the valve seat (24) when fluid flow is to be interrupted, and turning valve handle (20) to move the valve plug (23) away from the valve seat (24) when fluid flow is to be allowed.

During use, valve seats (24) can become scored, with the result being that fluid can leak from fluid entrance port location "A" to fluid exist port location "B" when the valve handle is turned to a closed position, (i.e., so that the valve plug (23) is in flush contact with valve seat (24)).

When a valve seat (24) becomes scored and the valve leaks as a result, the typical response of those in charge of valve operation and maintenance is to install a new valve. The expense involved can become great. The present invention provides means by which a valve can be reconditioned, thereby, large economic benefits can be secured.

Figure 5:
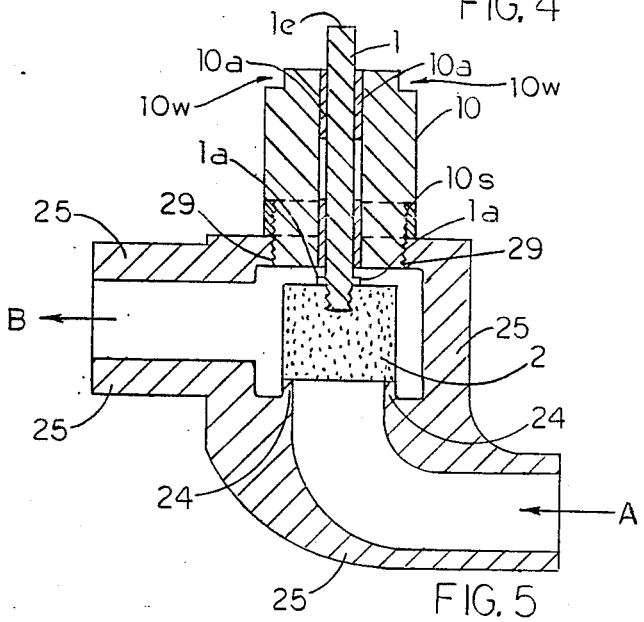
FIG. 5 shows a cross sectional view of a typical valve with the present invention mounted therein.

FIG. 5 shows a valve as in FIG. 4, but with the valve handle platform (21), valve handle (20), threaded valve handle shaft (22) and valve plug (23) removed and replaced with invention body element (10), shaft (1) and grinding element (2). Note that body element (10) attaches to the valve casing (25), by being screwed into said valve casing (25) by way of body element screw threads (10T) and valve casing screw threads (29). Note that some valves provide male connection means and for such valves the body element screw threads (10T) will be female, and the valve casing screw threads (29) will be male. Also shown is a spacer element (10*s*) which can be used if necessary to allow the grinding element (2) to be fit inside a valve with a short distance between the valve handle platform (21) and the valve seat (24). When the invention is mounted in a valve, rotational motion can be imparted to invention shaft (1) at shaft end (1*e*), and a force can be applied to the shaft (1) to cause it to move grinding element (2) into flush contact with valve seat (24). The resulting interaction of the rotating grinding element (2) with the valve seat (24) causes the valve seat (24) to be ground into a uniform flat surface. Note that in some valves the valve seat is tapered at an angle from horizontal. If that is the case the grinding element will be tapered to provide flush contact between the grinding element and valve seat.

It will be appreciated that the present invention provides means for salvaging fluid flow control valves, the seats in which have been scored. The present invention secures to a valve in a mechanical fashion leaving no chance for human error as regards grinding element (2) orientation with respect to the vale seat (24) being ground.

Figure 6:
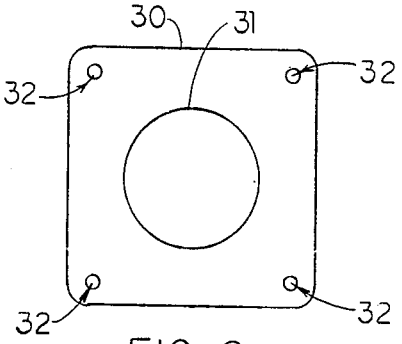
FIG. 6 shows a top view of an adaptor plate to which the present invention can be attached before being mounted to a valve.

Referring now to FIG. 6, there is shown a top view of an adaptor plate (30) which can serve as an adaptor to allow the present invention to be used on large valves. Briefly, the adaptor plate (30) attaches to a valve much as does the valve handle platform (21) in FIG. 4. Attachment means can be by way of screw threads such as those identified by the numeral (29) in FIG. 4, or by bolts such as those identified by numeral (28) in FIG. 4. Such an adaptor plate allows the invention body (10) to attach to the adaptor plate by screwing into screw threads, in the circumference of the area identified by numeral (31) in FIG. 6. A larger grinding element can then be affixed to the invention shaft (1) and a larger valve seat ground.

Having hereby disclosed the subject matter of this invention, it should be obvious that many modifications, substitutions, and variations of the present invention are possible in light of the teachings. It is therefore to be understood that the invention may be practiced other than as specifically described, and should be limited in breadth and scope only by the appended claims.

I claim:

1. A portable valve seat grinder for use on fluid control valves comprising a body element, which body element has a longitudinal hole there through and in which longitudinal hole are mounted two bushings, one at each end of the longitudinal hole, which body element further has screw threads on one end thereof suitable for attaching the body element to a valve or adaptor, and means for wrench access at the other end thereof, which body element further has knurling on its exterior surface; a shaft, which shaft has a means for attaching a grinding element on one end thereof and for attaching a source of rotational and longitudinal motion on the other end thereof; a grinding element, which grinding element is securily attached to said shaft; and which shaft with attached grinding element is mounted in the body element by sliding said shaft longitudinally into the bushings so that the grinding element is positioned adjacent to the screw threads on the body element and the opposite end of the shaft extends from the opposite end of the body element; which screw threads on one end of the body element serve to attach the portable valve seat grinder to a valve or adaptor such that the body element is, but for the screw threads, exterior to the valve when the body element is attached to same.

2. A portable valve seat grinder as in claim 1 which further comprises an adaptor which is attached to the screw threads on one side of the body element prior to mounting to a valve to allow use with valves of various sizes.

* * * * *